US005407890A

United States Patent [19]

Ishikawa

[11] Patent Number: 5,407,890

[45] Date of Patent: Apr. 18, 1995

[54] DECOLORING TYPE HEAT SENSITIVE IMAGE RECORDING MATERIAL

[75] Inventor: Shunichi Ishikawa, Kanagawa, Japan

[73] Assignee: Fuji Photo Film Co., Ltd., Kanagawa, Japan

[21] Appl. No.: 215,639

[22] Filed: Mar. 22, 1994

[30] Foreign Application Priority Data

Mar. 23, 1993 [JP] Japan ..... 5-063878
Jul. 6, 1993 [JP] Japan ..... 5-192003

[51] Int. Cl.[6] ..... B41M 5/30

[52] U.S. Cl. ..... 503/201; 427/150; 503/200; 503/207; 503/214; 503/216; 503/226

[58] Field of Search ..... 427/150; 503/200, 201, 503/205, 206, 214, 226, 207, 216

[56] References Cited

U.S. PATENT DOCUMENTS 4,773,778 9/1988 Pietsch et al. ..... 428/914

*Primary Examiner*—Pamela R. Schwartz
*Attorney, Agent, or Firm*—Birch, Stewart, Kolasch & Birch

[57] ABSTRACT

A decoloring type heat sensitive image recording material comprises a transparent support and a heat sensitive layer provided thereon. The heat sensitive layer contains color particles and a hydrophilic binder. The color particles are dispersed in the hydrophilic binder. The color particles are formed by a reaction of a leuco dye with a phenol developer. The heat sensitive layer substantially does not contain particles of a decoloring agent. The heat sensitive layer can be decolored in such a manner that a thermal energy applied to the image recording material causes a reaction of the color particles with the hydrophilic binder to decolor the particles, and that the decolored state is kept at room temperature. A process of recording an image by decoloring the heat sensitive material is also disclosed.

14 Claims, No Drawings

DECOLORING TYPE HEAT SENSITIVE IMAGE RECORDING MATERIAL

FIELD OF THE INVENTION

The present invention relates to a heat sensitive image recording material which forms a decolored negative image by applying a thermal energy to the image recording material. In more detail, the invention relates to a decoloring type heat sensitive image recording material which is available as a film sheet for forming a transparent image used in an overhead projector.

BACKGROUND OF THE INVENTION

A heat sensitive image recording material comprises a support and a heat sensitive layer that can be colored when a thermal energy is applied to the image recording material. The support is usually made of a paper or a plastic film. The heat sensitive image recording material is well known, and has been commercially used in a facsimile machine or a printer of a computer. The heat sensitive image recording material has an advantage that an image can be quickly recorded using a compact device. The heat sensitive material has another advantage of scarcely polluting the environment. Further, the heat sensitive material is economically advantageous, since the cost of preparing the material is not expensive.

On the other hand, a decoloring type heat sensitive image recording material has recently been proposed. The decoloring type recording material has a colored layer, which can be decolored by a thermal energy to form a negative image. The decoloring type recording material can be advantageously used as a sheet for an overhead projector (OHP) or a hard copy of a CRT image. The hard copy of the CRT image has frequently been used in medical devices, such as a X-ray radiographic device, a supersonic diagnostic device and a CT scanner. The decoloring type recording materials are described in Japanese Patent Provisional Publications No. 59(1984)-229385, No. 62(1987)-13389 and No. 62(1987)-249787.

The known decoloring type heat sensitive image recording material contains a colored dye and a decoloring agent (e.g., a polyethylene glycol derivative, a base). The colored dye is formed by a reaction of a leuco dye with an acidic developer. The leuco dye and the acidic developer are used in conventional heat sensitive or pressure sensitive image recording materials. The colored dye can be decolored by a reaction of the dye with the decoloring agent. The reaction is caused by a thermal energy. Thus, a white or transparent image over a color background is recorded within the heated area.

SUMMARY OF THE INVENTION

In the above-mentioned decoloring type heat sensitive image recording material, the colored dye should be separated from the decoloring agent to prevent causing a decoloring reaction while preparing or storing the recording material. The colored dye and the decoloring agent may be used in the form of particles for separation. The particles may be separately dispersed in a hydrophilic binder, and coated on a support to prepare a recording material. Further, the colored dye and the decoloring agent may be separately contained in two layers. The prepared recording material contains many particles of the colored dye and the decoloring agent. Accordingly, the transparency of the recording layer (heat sensitive layer) is relatively low because of light scattering caused by the particles. Further, the background color is turbid with the particles. Therefore, the recording material cannot preferably be used as an OHP film. Further, the thermal sensitivity of the recording material is insufficient. Therefore, it is difficult to print out an image of high quality using a conventional thermal printer of low energy.

An object of the present invention is to provide a decoloring type heat sensitive image recording material of high thermal sensitivity having a transparent image recording layer.

Another object of the invention is to provide a decoloring type heat sensitive image recording material that forms a clear negative image of high quality over a transparent color background.

The present invention provides a decoloring type heat sensitive image recording material which comprises a transparent support and a heat sensitive layer provided thereon, said heat sensitive layer containing color particles and a hydrophilic binder, said color particles being dispersed in the hydrophilic binder, and said color particles being formed by a reaction of a leuco dye with a phenol developer, wherein the heat sensitive layer substantially does not contain particles of a decoloring agent, and the heat sensitive layer can be decolored in such a manner that a thermal energy applied to the image recording material causes a reaction of the color particles with the hydrophilic binder to decolor the particles, and that the decolored state is kept at room temperature.

The present invention further provides a process of recording an image on the decoloring type heat sensitive image recording material which comprises imagewise applying a thermal energy to the image recording material.

The decoloring type heat sensitive image recording material of the present invention does not contain particles of any decoloring agents. However, the applicant has surprisingly noted that a negative color image can be formed because of the above-mentioned specific structure of the recording material, and the formed image can be kept at room temperature. The image recording material has a single and transparent heat sensitive layer, which does not contain particles of any decoloring agents. Therefore, the image recording material can form a clear negative image over a transparent color background. Further, the recording material has a high thermal sensitivity. For the reasons mentioned above, the decoloring type heat sensitive image recording material of the present invention can record an image of high quality by a thermal printer of a computer or by a thermal head of a facsimile machine.

DETAILED DESCRIPTION OF THE INVENTION

The color particles are formed by a reaction of a leuco dye with a phenol developer. The leuco dye preferably is a lactone compound, which has been used in a conventional heat sensitive or pressure sensitive material. Triphenylmethane phthalide leuco dyes, fluoran leuco dyes and indolyl phthalide leuco dyes are preferred.

Examples of the leuco dyes are shown below.

(1) 3,3-bis(p-dimethylaminophenyl)phthalide (2) 3,3-bis(p-dimethylaminophenyl)-6-dimethylaminophthalide (i.e., crystal violet lactone)

(3) 3,3-bis(p-dimethylaminophenyl)-6-diethylaminophthalide
(4) 3,3-bis(p-dimethylaminophenyl)-6-chlorophthalide
(5) 3,3-bis(p-dibutylaminophenyl)phthalide
(6) 3-cyclohexylamino-6-chlorofluoran
(7) 3-(N,N-diethylamino)-5-methyl-7-(N,N-dibenzylamino)fluoran
(8) 3-dimethylamino-5,7-dimethylfluoran
(9) 3-diethylamino-7-methylfluoran
(10) 3-diethylamino-7,8-benzofluoran
(11) 3-diethylamino-6-methyl-7-chlorofluoran
(12) 3-pyrrolidino-6-methyl-7-anilinofluoran
(13) 2-(N-(3-trifluoromethylphenyl)amino)-6-diethylaminofluoran
(14) 2-(3,6-bis(diethylamino)-9-(o-chloroanilino)xanthylbenzoic lactam The leuco dye is preferably used in an amount of 0.05 to 2 g/m$^2$, and more preferably used in an amount of 0.1 to 1 g/m$^2$.

In the present invention, a phenol developer is used as a color developer of the leuco dye. In a conventional heat sensitive material, an organic acid or its salt has frequently been used as the color developer. If the organic acid or its salt is used in the decoloring type heat sensitive recording material, the color could be decolored by a thermal energy, but the color would be restored at room temperature. Accordingly, the phenol developer used in the present invention preferably does not have a carboxyl group or its salt. The phenol developer has a melting point preferably in the range of 50° to 250° C., and more preferably in the range of 60° to 200° C. The phenol developer is preferably not or slightly soluble in water.

Examples of the phenol developers are shown below.
(1) 4,4-isopropylidene-diphenol (i.e., bisphenol A)
(2) p-tert-butylphenol, 2,4-dinitrophenol
(3) 3,4-dichlorophenol
(4) 4,4-methylene-bis(2,6-di-tert-butylphenol)
(5) p-phenylphenol
(6) 4,4-cyclohexylidenediphenol
(7) 2,2-methylenebis(4-tert-butylphenol)
(8) 2,2-methylenebis(a-phenyl-p-cresol)thiodiphenol
(9) 4,4-thiobis(6-tert-butyl-m-cresol)
(10) sulfonyldiphenol
(11) 1,1-bis(4-hydroxyphenyl)-2-ethyl-n-hexane
(12) 1,1-bis(4-hydroxyphenyl)-2-dodecane
(13) ethyl 4,4-bis(4-hydroxyphenyl)-1-pentanoate The color density increases, as the amount of the phenol developer increases. However, it is difficult to decolor the color particles of the increased density. The phenol developer is preferably used in an amount of 1 to 20 mol, and more preferably 2 to 10 mole per 1 mol of the leuco dye.

The leuco dye is reacted with the phenol developer to form color particles. The size of the color particles is preferably small as possible. The particle size relates to a transparency of the obtained image. Accordingly, the particles are preferably made small in the case that the transparency of the image is particularly required. For example, an OHP film particularly requires the transparency. The color particles preferably have an average particle size of not more than 1 μm, and more preferably in the range of 0.01 to 0.4 μm.

The fine color particles can be formed by dissolving the leuco dye and the phenol developer in an organic solvent which is essentially not miscible with water, and emulsifying the obtained solution in water. In the prepared emulsion, fine oily droplets are dispersed in water. The organic solvent is then removed from the oily droplets to obtain color particles. Examples of the organic solvents include ethyl acetate, isopropyl acetate and methyl ethyl ketone. An oil having a high boiling point can be added to the organic solvent. A hydrocarbon oil is preferably used because hydrocarbon does not inhibit the color developing reaction of the leuco dye. The thermal sensitivity of the recording material can be increased by adding the oil to the organic solvent. However, the oil may decrease the density of the background color. Accordingly, the amount of the oil is preferably not larger than the total amount of the leuco dye and the phenol developer.

The color particles may also be formed according to conventional methods. One of the conventional method comprises dispersing a leuco dye and a developer together in an aqueous medium at an elevated temperature. Another method comprises mixing separated dispersions of a leuco dye and a developer with an organic solvent. According to the conventional methods, relatively large color particles are formed.

The color particles formed from the leuco dyes and the phenol developers are dispersed in a hydrophilic binder. The known nonionic, anionic or cationic hydrophilic polymers are available as the hydrophilic binder. The molecular structure of the hydrophilic polymer contains a hydrophilic group such as hydroxyl, carbonyl, ether and amino. Examples of the hydrophilic binders are described in pages 128 to 134 of Published Technical Information No. 5, Aztech Ltd., Mar. 22, 1991. The hydrophilic binders have a function of decoloring the color particles at an elevated temperature. Some binders may decolor the particles in preparation of the heat sensitive material. In such a case, the conditions of the preparation should be adjusted to prevent decoloring reaction in preparation of the material. The hydrophilic binders preferably have another function of dispersing the leuco dye and the developer. Gelatin or polyvinyl alcohol is preferred. Gelatin is particularly preferred in view of the above-mentioned two functions.

The hydrophilic binder may be added to an aqueous medium before dispersing the leuco dye and the developer. The binder may also be added to a coating solution of a heat sensitive layer after dispersing the leuco dye and the developer.

The heat sensitive layer preferably contains the hydrophilic binder in an amount of 80 to 1,000 wt. % based on the amount of the phenol developer. If the amount is less than 80 wt. %, the thermal sensitivity is low that the transparency of the printed white (heated and decolored) area might be insufficient. If the amount is more than 1,000 wt. %, the density of the color particles (background density) might be insufficient.

The decoloring type heat sensitive image receiving material of the present invention substantially does not contain particles of a decoloring agent. The conventional decoloring type heat sensitive image receiving material should contain a decoloring agent such as (a) alkylene oxide additives of bisphenols; (b) amides (e.g., methylol amide, bisamide, acetamide); (c) long chain 1,2-glycols; (d) ethylene oxide additives of terephthalic acid; (e) solid alcohols (e.g., stearyl alcohol); polyethers or polyethylene glycol; (g) guanidine derivatives; and (h) amines or quarternary ammonium salts. In the present invention, the term substantially does not contain means that the amount of the particles of the decoloring agent is not more than 0.05 g/m$^2$. The amount of the particles of the decoloring agent preferably is zero. In other words, the heat sensitive layer preferably does not contain the particles at all.

The heat sensitive layer can be decolored in such a manner that a thermal energy applied to the image recording material causes a reaction of the color particles with the hydrophilic binder to decolor the particles. The decolored state of the heat sensitive layer can be kept at room temperature. The decoloring type heat sensitive image recording material requires the thermal energy of about 10 $mJ/mm^2$ or more. The thermal energy of about 10 $mJ/mm^2$ can easily be generated by a thermal head attached to a conventional thermal printer of a computer, a word processor or a facsimile machine. Accordingly, the decoloring type heat sensitive image recording material of the present has a high thermal sensitivity.

The conventional decoloring type heat sensitive image receiving materials contain a considerable amount (more than 1 $g/m^2$) of a decoloring agent. On the other hand, the recording material of the present invention can form a decolored image though the heat sensitive layer substantially does not contain particles of the decoloring agent. This surprising effect cannot be expected from the prior art about the conventional decoloring type heat sensitive image receiving materials. Further, the recording material can form a transparent image because the heat sensitive layer substantially does not contain particles of the decoloring agent. Furthermore, the stability (preservability) of the material of the invention is excellent because the layer substantially does not contain the decoloring agent.

The mechanism of the decoloring reaction in the present invention has not completely been analyzed. With respect to the mechanism, the applicant considers that the hydrophilic binder intervenes into the bond of the leuco dye with the developer contained in the color particles when a thermal energy is applied to the heat sensitive layer. It is thought that the hydrophilic binder separates the leuco dye from the developer to decolor the color particles.

The heat sensitive layer preferably has a thickness in the range of 0.2 to 10 μm, and more preferably in the range of 0.5 to 5 μm.

The heat sensitive layer is provided on a transparent support. A plastic film is preferably used as the transparent support. Examples of the plastic films include polyester (e.g., polyethylene terephthalate, polyethylene naphthalate) films, cellulose derivative (e.g, cellulose triacetate) films, polyolefin (e.g, polystyrene, polyethylene, polypropylene) films and other films (e.g., polyimide film, polyvinyl chloride film, polyvinylidene chloride film, polyacrylic film, polycarbonate film). The polyester films are particularly preferred. The polyester films are preferably subjected to a heat resisting treatment or an antistatic treatment.

The transparent support preferably has a thickness in the range of 50 to 300 μm, and more preferably in the range of 75 to 200 μm.

An undercoating layer is preferably provided between the transparent support and the heat sensitive layer. The undercoating layer has a function of adhering the heat sensitive layer on the transparent support. The undercoating layer contains a binder. Examples of the binders include gelatin, a copolymer of an acrylic ester, polyvinylidene chloride, a styrene-butadiene latex and a water-soluble polyester. The thickness of the undercoating layer is preferably in the range of 0.1 to 0.5 μm.

The undercoating layer preferably contains particles of an electro-conductive metal oxide. The electro-conductive undercoating layer has a function of preventing electrostatic adhesion between the heat sensitive materials to improve handling of the materials. The particles of an electro-conductive metal oxide preferably have an average particle size of not more than 0.2 μm. The particles are dispersed in a binder of the undercoating layer. The surface electric resistance of the electro-conductive undercoating layer is preferably in the range of $1\times10^{10}$ to $1\times10^{13}$ at 25° C. and the relative humidity (RH) of 65%. The surface electric resistance is more preferably in the above-mentioned range under any conditions at 10° C. and 30% RH, at 25° C. and 65% RH, and at 30° C. and 90% RH. Examples of the electro-conductive metal oxides include ZnO, $TiO_2$, $SnO_2$, $Al_2O_3$, $In_2O_3$, $SiO_2$, MgO, BaO and $MoO_3$. Two or more metal oxides can be used in combination. Complex metal oxides are also available. The metal oxide preferably further contains an hetero atom. For example, the ZnO particles are preferably doped with Al or In. The $TiO_2$ particles are preferably doped with Nb or Ta. The $SnO_2$ particles are preferably doped with Sb, Nb or a halogen atom. The $SnO_2$ particles doped with Sb are particularly preferred, since they show a stable electro-conductivity.

The particle size of the electro-conductive metal oxide is preferably made small as possible to reduce light scattering caused by the particles. In the case that the heat sensitive image recording material is used for projecting a transparent image, the light scattering is preferably reduced to not more than 20%. Such a transparent image recording material is advantageously used in an overhead projector (OHP). The average particle size of the electro-conductive metal oxide is preferably not more than 0.2 μm, and more preferably not more than 0.1 μm to reduce the light scattering.

There is no specific limitation with respect to the binder of the electro-conductive undercoating layer. An aqueous polymer is available as the binder. Examples of the aqueous polymers include polyvinyl alcohol, polyacrylic acid, polyacrylamide, polyhydroxyethyl acrylate, polyvinyl pyrrolidone, a water-soluble polyester, a water-soluble polyurethane, a water-soluble polyamide (nylon), a water-soluble epoxy resin, gelatin, hydroxyethyl cellulose, hydroxypropyl cellulose, carboxymethyl cellulose and derivative thereof. The other polymers such as an acrylic resin, polyester, polyvinyl acetate and SBR (styrene-butadiene rubber) are also available as the binder.

The binder polymers are preferably used in the form of an aqueous dispersion or emulsion. The polymers are more preferably used in the form of an aqueous dispersion. An acrylic resin or a polyester is preferred to prepare the dispersion. The polymer for the aqueous dispersion preferably has a polar group in its molecular structure. Examples of the polar groups include a quarternary ammonium salt group, sulfo, a sulfonic salt group, carboxyl, a carboxylic salt group, a phosphoric acid group and a phosphoric salt group. The amount of the polar group is preferably in the range of 0.1 to 10 wt. %, and more preferably in the range of 1 to 5 wt. % based on the amount of the polymer. The "wt. %" means the weight percentage of a monomer having the polar group based on the total amounts of monomers that form the binder polymer. An ammonium carboxylate is preferably used as the polar group. An acrylic resin is preferably used as the binder of the undercoating layer.

The undercoating layer may further contain a cross-linking agent or a surface active agent.

The weight ratio of the metal oxide particles to the polymer binder is preferably in the range of 1:3 to 3:1. The thickness of the electro-conductive undercoating layer is preferably arranged to adjust the surface electric resistance in the range of $1\times10^{10}$ to $1\times10^{13}$ Ψ at 30 to 90 RH. The thickness is preferably in the range of 0.01 to 1.00 μm, and more preferably in the range of 0.05 to 0.5 μm.

A coating solution of the electro-conductive under coating layer can be formed by dispersing or dissolving the metal oxide particles and the binder (and optionally a surface active agent) in water. The coating solution is coated on a transparent support, dried by heat to form the electro-conductive under coating layer.

The undercoating layer can be coated according to various methods. An air doctor coater, a blade coater, a rod coater, a knife coater, a squeeze coater, a reverse roll coater and a bar coater are available for the coating method.

A protective layer can be provided on the heat sensitive layer. The protective layer has a function of protecting the heater sensitive layer from water and mechanical scratching. The protective layer has another function of increasing the tranaparency of the heat sensitive material. The protective layer can be made from a polymer. Examples of the polymer include polyvinyl alcohol, a denatured polyvinyl alcohol, gelatin, a styrene-maleic anhydride copolymer and starch. Two or more polymers can be used in combination. A hardening agent for the polymer can be added to the protective layer. The protective layer can further contain hardening agents such as borax, boric acid or colloidal silica. The colloidal silica can function as a hardening agent for denatured polyvinyl alcohols such as a silanol denatured polyvinyl alcohol.

The protective layer can furthermore contain a lubricant or a pigment to improve the handling or to prevent an adhesion of the material from a thermal head used in a thermal recording. Examples of the lubricants include zinc stearate and paraffin wax. Examples of the pigments include kaolin and calcium carbonate.

The coating amount of the protective layer is preferably in the range of 0.1 to 3 g/m$^2$.

The decoloring type heat sensitive image recording material can form and record a transparent (white) image over a color background by using a thermal printer of a computer, a word processor or a facsimile machine. The image can also be recorded by a scanning exposure of a laser beam.

The heat sensitive image recording material may further contain an infrared absorbing substance. The substance can change the infrared ray to a thermal energy, which decolor the color particles. The infrared rays include an infrared laser beam. Examples of the infrared absorbing substances are described in Japanese Patent Provisional Publications No. 2(1990)-2074, No. 3(1991)-26593, No. 3(1991)-30992, No. 3(1991)-34891, No. 3(1991)-36093, No. 3(1991)-36094, No. 3(1991)-36095, No. 3(1991)-42281, No. 3(1991)-63185, No. 3(1991)-97589, No. 3(1991)-97590, No. 3(1991)-97591, No. 4(1992)-161382, No. 4(1992)-173185, No. 4(1992)-173290, No. 4(1992)-173291 and U.S. Pat. No. 5,019,594.

Two or more infrared absorbing substances can be used in combination.

The infrared absorbing substance can be added to the heat sensitive layer. The substance can also be added to another layer adjacent to the heat sensitive layer. In the case that the substance is contained in the heat sensitive layer, the substance can be contained in the color particles. The substance can also be contained in the hydrophilic binder of the heat sensitive layer. The adjacent layers include the undercoating layer and the protective layer. The infrared absorbing substance can be added to a layer provided on the reversal side of the support. The layer containing the infrared absorbing substance can be prepared by dispersing the substance in a binder and coating the dispersion. Examples of the binders are the same as the binders used in the heat sensitive layer or the undercoating layer. The binder used in the heat sensitive layer is preferably used as the binder of the layer containing the infrared absorbing substance.

The amount of the infrared absorbing substance should be adjusted to change an infrared ray to a thermal energy of not less than about 10 mJ/mm$^2$, which is required for the thermal recording of the present invention. The amount is preferably so adjusted that the infrared light absorbance is not less than 0.2, and more preferably is not less than 0.5. The amount is usually in the range of 0.001 to 1 g/m$^2$.

The weight ratio of the binder to the infrared absorbing substance is preferably in the range of 0.1 to 100, and more preferably in the range of 0.5 to 10.

EXAMPLE 1

Preparation of Color Particle Dispersion (NB-1)

In 30 g of ethyl acetate, 2.2 g of the following leuco dye (LD-1) and 6.4 g of the following phenol developer (PH-1) were dissolved to form a color solution. With 5 g of 5% aqueous solution of sodium dodecylbenzenesulfonate, 57 g of 14% aqueous solution of lime-treated gelatin was mixed. The mixture was placed in a homogenizer cup of 200 cc. The color solution was added to the mixture, and the resulting mixture was stirred at 10,000 rpm for 5 minutes to obtain a color particle dispersion (NB-1) having the average particle size of about 0.3 μm.

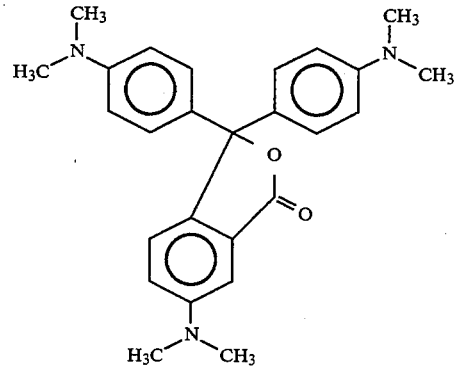

(LD-1)

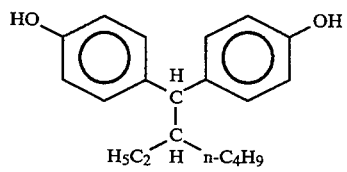

(PH-1)

Preparation of Heat Sensitive Image Recording Material 101

To 4.2 g of the color particle dispersion (NB-1), 7.5 g of water and 3 g of 1% aqueous solution of the following surface active agent (WW-1) were added. The resulting mixture was coated and dried on a polyethylene terephthalate film (thickness: 100 μm) having a gelatin undercoating layer in the coating amount of 31.5 cc/m$^2$ to obtain an almost transparent blue heat sensitive image recording material 101. The transmission density of the material was measured using a densitometer (X-RITE 310). As a result, the cyan density of the material was 0.8.

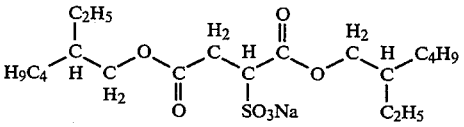

(WW-1)

Evaluation of Heat Sensitive Image Recording Material 101

A character pattern was printed on the heat sensitive image recording material 101 using a thermal printer of a word processor (OASYS 30LXIII, Fujitsu Ltd.). As a result, the printed area was decolored to form a transparent image.

The image was projected by a transparent type overhead projector. A clear projected image was observed.

The image was then projected by a reflective type overhead projector. The background of the reflected image was slightly turbid with a dark color. The reflected image was rather inferior to the projected image. However, the character patterns were clearly observed.

EXAMPLE 2

Preparation of Heat Sensitive Image Recording Material 102

With 4.7 g of water, 3.8 g of 14% aqueous solution of gelatin, 5 g of 5% aqueous solution of sodium dodecylbenzenesulfonate and 0.5 g of 20% aqueous dispersion of zinc stearate particles (size: 0.2 μm) were mixed to prepare a coating solution of a protective layer. The coating solution was coated and dried on the heat sensitive recording material 101 prepared in Example 1 in the coating amount of 24.5 cc/m$^2$. Thus a heat sensitive image recording material 102 was prepared. The color of the material 102 was completely transparent blue.

Evaluation of Heat Sensitive Image Recording Material 102

A character pattern was printed on the heat sensitive image recording material 102 in the same manner as in Example 1. As a result, the printed area was decolored to form a clear transparent image.

The image was projected by a transparent type overhead projector. A very clear projected image was observed.

The image was then projected by a reflective type overhead projector. The background of the reflected image was clear. However, the character patterns were clearly observed. Further, no scratch was observed, while a few scratches were observed in the obtained image of Example 1.

EXAMPLE 3

Preparation of Heat Sensitive Image Recording Material 103

With 1 g of water, 8 g of 10% aqueous solution of polyvinyl alcohol, 10 g of 5% aqueous solution of sodium dodecylbenzenesulfonate and 1 g of 20% aqueous dispersion of zinc stearate particles (size: 0.2 μm) were mixed to prepare a coating solution of a protective layer. The coating solution was coated and dried on the heat sensitive recording material 101 prepared in Example 1 in the coating amount of 35 cc/m$^2$. Thus a heat sensitive image recording material 103 was prepared. The color of the material 103 was completely transparent blue.

Evaluation of Heat Sensitive Image Recording Material 103

A character pattern was printed on the heat sensitive image recording material 103 in the same manner as in Example 1. As a result, the printed area was decolored to form a clear transparent image.

The image was projected by a transparent type overhead projector. A very clear projected image was observed. The transparency (white) of the printed area was particularly excellent.

Further, an image containing a character and a figure was copied on the image recording material 103 using a facsimile machine (GIII class). Thus a clear negative image was formed.

The image was projected by a transparent type overhead projector. The transparency (white) of the printed area was superior to the image formed by the thermal printer, though the clearance of the character was rather inferior to the image formed by the thermal printer.

EXAMPLE 4

Preparation of Leuco Dye and Developer Dispersions

With 124 g of 5% aqueous solution of gelatin, 8.8 g of the leuco dye (LD-1) was mixed. The mixture was stirred in a ball mill to obtain a leuco dye dispersion (average particle size: 3 μm). With 124 g of 5% aqueous solution of gelatin, 25.6 g of the phenol developer was mixed to obtain a developer dispersion (average particle size: 3 μm).

Preparation of Heat Sensitive Image Recording Material 104

To 3.4 g of water, 2.1 g of the leuco dye dispersion, 2.1 g of the developer dispersion, 2.1 g of 14% aqueous solution of gelatin and 3 g of 1% aqueous solution of the surface active agent (WW-1) were added. The resulting mixture was coated and dried on a polyethylene terephthalate film used in Example 1 in the coating amount of 31.5 cc/m$^2$ to obtain a transparent blue heat sensitive image recording material. The transparency of the recording material was insufficient.

A protective layer was then provided on the recording material in the same manner as in Example 3 to obtain a heat sensitive image recording material 104. As a result, the transparency was improved to some extent.

Evaluation of Heat Sensitive Image Recording Material 104

A character pattern was printed on the heat sensitive image recording material 104 in the same manner as in Example 1. The image was projected by a transparent type overhead projector. Though the character pattern was readable, the decoloring of the character was insufficient and the background was turbid with dark blue.

EXAMPLE 5

Preparation of Color Article Dispersion (NB-2)

In 30 g of ethyl acetate, 2.2 g of the leuco dye (LD-1) and 4.8 g of bisphenol A were dissolved to form a color solution. With 5 g of 5% aqueous solution of sodium dodecylbenzenesulfonate, 57 g of 14% aqueous solution of lime-treated gelatin was mixed. The mixture was placed in a homogenizer cup of 200 cc. The color solution was added to the mixture, and the resulting mixture was stirred at 10,000 rpm for 5 minutes to obtain a color particle dispersion (NB-2) having the average particle size of about 0.3 μm.

Preparation of Heat Sensitive Image Recording Material 105

A heat sensitive image recording material 105 was prepared in the same manner as in Example 1, except that the color particle dispersion (NB-2) was used in place of the dispersion (NB-1).

Evaluation of Heat Sensitive Image Recording Material 105

A character pattern was printed on the heat sensitive image recording material 105 in the same manner as in Example 1. The image was projected by a transparent type overhead projector. As a result, a clear image was projected.

EXAMPLE 6

Preparation of Color Particle Dispersion (NB-3)

In 30 g of ethyl acetate, 2.2 g of the leuco dye (LD-1) and 6.48 g of the phenol developer (PH-1) were dissolved to form a color solution. With 10 g of 5% aqueous solution of sodium dodecylbenzenesulfonate, 31 g of 20% aqueous solution of polyvinyl alcohol and 21 g of water were mixed. The mixture was placed in a homogenizer cup of 200 cc. The color solution was added to the mixture, and the resulting mixture was stirred at 10,000 rpm for 5 minutes to obtain a color particle dispersion (NB-3) having the average particle size of about 0.3 μm.

Preparation of Heat Sensitive Image Recording Material 106

To 5.6 g of the color particle dispersion (NB-3), 3 g of water and 1 g of 20% aqueous solution of polyvinyl alcohol were added. The resulting mixture was coated and dried on the polyethylene terephthalate film used in Example 1 in the coating amount of 35 cc/m$^2$.

A protective layer of polyvinyl alcohol was then provided on the heat sensitive layer in the same manner as in Example 3 to obtain a heat sensitive image recording material 106. The transparency of the recording material 106 was 0.75.

Evaluation of Heat Sensitive Image Recording Material 106

A character pattern was printed on the heat sensitive image recording material 106 in the same manner as in Example 1. The image was projected by a transparent type overhead projector. As a result, a clear image was projected.

EXAMPLE 7

Preparation of Color Particle Dispersion (NB-4)

In 17.5 g of ethyl acetate, 2.8 g of the following leuco dye (LD-2) and 7.3 g of the phenol developer (PH-1) were dissolved to form a color solution. With 5 g of 5% aqueous solution of sodium dodecylbenzenesulfonate, 57 g of 14% aqueous solution of lime-treated gelatin was mixed. The mixture was placed in a homogenizer cup of 200 cc. The color solution was added to the mixture, and the resulting mixture was stirred at 10,000 rpm for 5 minutes to obtain a color particle dispersion (NB-4) having the average particle size of about 0.3 μm.

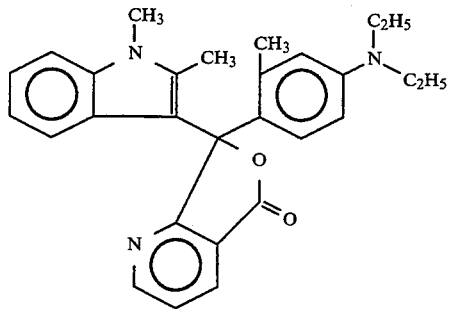

(LD-2)

Preparation of Heat Sensitive Image Recording Material 107

A heat sensitive image recording material 107 was prepared in the same manner as in Example 1, except that the color particle dispersion (NB-4) was used in place of the dispersion (NB-1).

Evaluation of Heat Sensitive Image Recording Material 107

A character pattern was printed on the heat sensitive image recording material 107 in the same manner as in Example 1. The image was projected by a transparent type overhead projector. As a result, a clear image was projected.

COMPARISON EXAMPLE 1

Preparation of Color Particle Dispersion (NB-5)

In 30 g of ethyl acetate, 2.1 g of the leuco dye (LD-1) and 7.5 g of the salicylic acid developer (PH-2) were dissolved to form a color solution. With 10 g of 5% aqueous solution of sodium dodecylbenzenesulfonate, 31 g of 20 aqueous solution of polyvinyl alcohol and 21 g of water were mixed. The mixture was placed in a homogenizer cup of 200 cc. The color solution was added to the mixture, and the resulting mixture was stirred at 10,000 rpm for 5 minutes to obtain a color particle dispersion (NB-5) having the average particle size of about 0.3 μm.

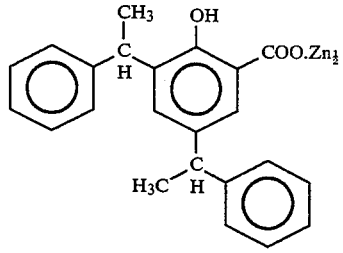

(PH-2)

Preparation of Heat Sensitive Image Recording Material 108

A heat sensitive image recording material 108 was prepared in the same manner as in Example 1, except that the color particle dispersion (NB-5) was used in place of the dispersion ( NB- 1 ).

Evaluation of Heat Sensitive Image Recording Material 108

A character pattern was printed on the heat sensitive image recording material 108 in the same manner as in Example 1. As a result, the printed area was not decolored and no image was formed.

The material 108 was then heated on a hot plate. As a result, the material was decolored. However, the color was restored at room temperature.

COMPARISON EXAMPLE 2

Preparation of Heat Sensitive Image Recording Material 109

To 150 g of 5% aqueous solution of polyvinyl alcohol, 30 g of triphenylguanidine (decoloring agent) was added. The resulting mixture was stirred in a ball mill to obtain a decoloring agent dispersion (average particle size: 2 μm).

A heat sensitive image recording material 109 was prepared in the same manner as in Example 6, except that 4.8 g of the decoloring agent dispersion was added to the coating solution of the heat sensitive layer and the coating amount was changed from 35 cc/m$^2$ to 52.5 cc/m$^2$.

The color density of the material 109 was low (0.6), and the transparency was also degraded.

Evaluation of Heat Sensitive Image Recording Material 109

A character pattern was printed on the heat sensitive image recording material 109 in the same manner as in Example 1. The image was projected by a transparent type overhead projector. As a result, the image quality image was insufficient and the background of the image was turbid with a dark color though the projected image was readable.

EXAMPLE 8

Preparation of Coating Solution for Electro-conductive Undercoating Layer

A coating solution of the following composition was prepared. In the following composition, the amounts of the components (except pure water) mean the solid or non-volatile contents of the components.

| | |
|---|---|
| Water-soluble acrylic resin (Julimer ET-410, ammonium carboxylate: 2 wt. %, Nippon Junyaku Co., Ltd.) | 1.55 g |
| Tin dioxide doped with antimony (SN-88, average particle size: 88 nm, Ishihara Sangyo Kaisha, Ltd.) | 1.80 g |
| Sodium sulfonate surface active agent (Sanded BL, Sanyo Chemical Industries, Ltd.) | 0.125 g |
| Nonionic surface active agent (EMALEX/NP8.5, Nippon Emulsion Co., Ltd.) | 0.125 g |
| Pure water | 96.4 g |

Preparation of Transparent Film Support

The above-prepared coating solution was coated on a polyethylene terephthalate film (thickness: 100 μm) treated with a corona discharge to form an electro-conductive undercoating layer (thickness: 0.15 μm). The coating was conducted using a bar coater of #2.4 at the coating speed of 105 meter per minute. Thus a transparent film support was prepared.

The surface electric resistance of the transparent film support was measured using an insulation resistance tester (TR-8601, Advantest Ltd. ) after 1 minute of an electric conduction. The surface electric resistance at 10° C. and 30% relative humidity (RH) was $5\times10^{10}$ Ψ, the surface resistance at 25° C. and 65% RH was $1\times10^{11}$ Ψ, and the resistance at 30° C. and 90% RH was $5\times10^{11}$ Ψ.

Preparation of Heat Sensitive Image Recording Material 110

To 4.2 g of the color particle dispersion (NB-1), 7.5 g of water and 3 g of 1% aqueous solution of the surface active agent (WW-1) were added. The resulting mixture was coated and dried on the electro-conductive undercoating layer of the transparent film support in the coating amount of 31.5 cc/m$^2$ to obtain an almost transparent blue heat sensitive image recording material 110. The transmission density of the material was measured using a densitometer (X-RITE 310). As a result, the cyan density of the material was 0.8.

Evaluation of Heat Sensitive Image Recording Material 110

A character pattern was printed on the heat sensitive image recording material 110 in the same manner as in Example 1. As a result, the printed area was decolored to form a transparent image.

The image was projected by a transparent type overhead projector. A very clear projected image was observed.

The image was then projected by a reflective type overhead projector. The character patterns were clearly observed, though the reflected image was rather inferior to the projected image.

EXAMPLE 9

Preparation of Heat Sensitive Image Recording Material 111

With 4.7 g of water, 3.8 g of 14% aqueous solution of gelatin, 5 g of 5% aqueous solution of sodium dodecylbenzenesulfonate and 0.5 g of 20% aqueous dispersion of zinc stearate particles (size: 0.2 μm) were mixed to prepare a coating solution of a protective layer. The coating solution was coated and dried on the heat sensitive recording material 110 prepared in Example 8 in the coating amount of 24.5 cc/m$^2$. Thus a heat sensitive image recording material 111 was prepared. The color of the material 111 was completely transparent blue.

Evaluation of Heat Sensitive Image Recording Material 111

A character pattern was printed on the heat sensitive image recording material 111 in the same manner as in Example 1. As a result, the printed area was decolored to form a clear transparent image.

The image was projected by a transparent type overhead projector. A very clear projected image was observed.

The image was then projected by a reflective type overhead projector. A reflected image has a clear background compared with the image of Example 8. Further, no scratch was observed.

EXAMPLE 10

Preparation of Heat Sensitive Image Recording Material 112

With 1 g of water, 8 g of 10% aqueous solution of polyvinyl alcohol, 10 g of 5% aqueous solution of sodium dodecylbenzenesulfonate and 1 g of 20% aqueous dispersion of zinc stearate particles (size: 0.2 μm) were mixed to prepare a coating solution of a protective layer. The coating solution was coated and dried on the heat sensitive recording material 110 prepared in Example 8 in the coating amount of 35 cc/m$^2$. Thus a heat sensitive image recording material 103 was prepared. The color of the material 112 was completely transparent blue.

Evaluation of Heat Sensitive Image Recording Material 112

A character pattern was printed on the heat sensitive image recording material 112 in the same manner as in Example 1. As a result, the printed area was decolored to form a clear transparent image.

The image was projected by a transparent type overhead projector. A very clear projected image was observed. The transparency (white) of the printed area was particularly excellent.

Further, an image containing a character and a figure was copied on the image recording material 112 using a facsimile machine (GIII class). Thus a clear negative image was formed.

The image was projected by a transparent type overhead projector. The transparency (white) of the printed area was superior to the image formed by the thermal printer, though the clearance of the character was rather inferior to the image formed by the thermal printer.

EXAMPLE 11

Preparation of Heat Sensitive Image Recording Material 113

A heat sensitive image recording material was prepared in the same manner as in Example 4, except that the transparent film support prepared in Example 8 was used in place of the support prepared in Example 4. The transparency of the blue color was insufficient.

A protective layer was then provided on the recording material in the same manner as in Example 10 to obtain a heat sensitive image recording material 113. As a result, the transparency was improved to some extent.

Evaluation of Heat Sensitive Image Recording Material 113

A character pattern was printed on the heat sensitive image recording material 113 in the same manner as in Example 1. The image was projected by a transparent type overhead projector. Though the character pattern was readable, the decoloring of the character was insufficient and the background was turbid with dark blue.

EXAMPLE 12

Preparation of Heat Sensitive Image Recording Material 114

A heat sensitive image recording material 114 was prepared in the same manner as in Example 5, except that the transparent film support prepared in Example 8 was used.

Evaluation of Heat Sensitive Image Recording Material 114

A character pattern was printed on the heat sensitive image recording material 114 in the same manner as in Example 1. The image was projected by a transparent type overhead projector. As a result, a clear image was projected.

EXAMPLE 13

Preparation of Heat Sensitive Image Recording Material 115

A heat sensitive image recording material 115 was prepared in the same manner as in Example 6, except that the transparent film support prepared in Example 8 was used.

Evaluation of Heat Sensitive Image Recording Material 115

A character pattern was printed on the heat sensitive image recording material 115 in the same manner as in Example 1. The image was projected by a transparent type overhead projector. As a result, a clear image was projected.

EXAMPLE 14

Preparation of Heat Sensitive Image Recording Material 116

A heat sensitive image recording material 116 was prepared in the same manner as in Example 7, except that the transparent film support prepared in Example 8 was used.

Evaluation of Heat Sensitive Image Recording Material 116

A character pattern was printed on the heat sensitive image recording material 116 in the same manner as in Example 1. The image was projected by a transparent type overhead projector. As a result, a clear image was projected.

EXAMPLE 15

Preparation of Color Particle Dispersion (NB-6)

In 30 g of ethyl acetate, 2.2 g of the leuco dye (LD-1) and 16 g of the phenol developer (PH-1) were dissolved to form a color solution. With 5 g of 5% aqueous solution of sodium dodecylbenzenesulfonate, 57 g of 14% aqueous solution of lime-treated gelatin was mixed. The mixture was placed in a homogenizer cup of 200 cc. The color solution was added to the mixture, and the resulting mixture was stirred at 10,000 rpm for 5 minutes to obtain a color particle dispersion (NB-6) having the average particle size of about 0.3 μm.

Preparation of Heat Sensitive Image Recording Material 117

To 4.0 g of the color particle dispersion (NB-6), 2.4 g of 14% aqueous solution of gelatin and 3 g of 1% aqueous solution of the surface active agent (WW-1) were added. The resulting mixture was coated and dried on a polyethylene terephthalate film (thickness: 100 μm) having a gelatin undercoating layer in the coating amount of 31.5 cc/m$^2$ to obtain an almost transparent blue heat sensitive image recording material 117. The transmission density of the material was measured using a densitometer (X-RITE 310). As a result, the cyan density of the material was 0.9.

Evaluation of Heat Sensitive Image Recording Material 117

A character pattern was printed on the heat sensitive image recording material 117 in the same manner as in Example 1. The image was projected by a transparent type overhead projector. As a result, a clear image was projected.

COMPARISON EXAMPLE 3

Preparation of Heat Sensitive Image Recording Material 118

To 4.6 g of the color particle dispersion (NB-6), 7.1 g of water and 3 g of 1% aqueous solution of the surface active agent (WW-1) were added. A heat sensitive image recording material 118 was prepared in the same manner as in Example 15, except that the resulting mixture was used. The cyan density of the material was 1.3.

Evaluation of Heat Sensitive Image Recording Material 118

A character pattern was printed on the heat sensitive image recording material 118 in the same manner as in Example 1. The transparency (white) of the printed area was insufficient. The image was projected by a transparent type overhead projector. As a result, the projected image was unclear.

I claim:

1. A decoloring heat sensitive image recording material which comprises a transparent support and a heat sensitive layer provided thereon, said heat sensitive layer containing color particles and a hydrophilic binder, said color particles being dispersed in the hydrophilic binder, and said color particles being formed by a reaction of a leuco dye with a phenol developer, wherein the heat sensitive layer substantially does not contain particles of a decoloring agent, and the heat sensitive layer can be decolored in such a manner that a thermal energy applied to the image recording material causes a reaction of the color particles with the hydrophilic binder to decolor the particles, such that the decolored state remains at room temperature.

2. The decoloring heat sensitive image recording material as claimed in claim 1, wherein the heat sensitive layer contains the leuco dye in an amount of 0.05 to 2 g/m$^2$.

3. The decoloring heat sensitive image recording material as claimed in claim 1, wherein the phenol developer has a melting point in the range of 50° to 250° C.

4. The decoloring heat sensitive image recording material as claimed in claim 1, wherein the heat sensitive layer contains the phenol developer in an amount of 1 to 20 mol per 1 mol of the leuco dye.

5. The decoloring heat sensitive image recording material as claimed in claim 1, wherein the color particles have an average particle size in the range of 0.01 to 0.4 μm.

6. The decoloring heat sensitive image recording material as claimed in claim 1, wherein the color particles are formed by dissolving the leuco dye and the phenol developer in an organic solvent which is essentially not miscible with water, and emulsifying the obtained solution in water.

7. The decoloring heat sensitive image recording material as claimed in claim 1, wherein the hydrophilic binder is gelatin or polyvinyl alcohol.

8. The decoloring heat sensitive image recording material as claimed in claim 1, wherein the heat sensitive layer contains the hydrophilic binder in an amount of 80 to 1,000 wt. % based on the amount of the phenol developer.

9. The decoloring heat sensitive image recording material as claimed in claim 1, wherein an undercoating layer containing a binder is provided between the transparent support and the heat sensitive layer.

10. The decoloring heat sensitive image recording material as claimed in claim 9, wherein the undercoating layer further contains particles of an electro-conductive metal oxide, said particles being dispersed in the binder.

11. The decoloring heat sensitive image recording material as claimed in claim 10, wherein the particles of an electro-conductive metal oxide have an average particle size of not more than 0.2 μm.

12. A process of recording an image on a decoloring heat sensitive image recording material which comprises imagewise applying a thermal energy to the image recording material, wherein the image recording material comprises a transparent support and a heat sensitive layer provided thereon, said heat sensitive layer containing color particles and a hydrophilic binder, said color particles being dispersed in the hydrophilic binder, and said color particles being formed by a reaction of a leuco dye with a phenol developer, and wherein the heat sensitive layer substantially does not contain particles of a decoloring agent, and the heat sensitive layer is decolored in such a manner that the thermal energy applied to the image recording material causes a reaction of the color particles with the hydrophilic binder to decolor the particles, such that the decolored state remains at room temperature.

13. The process of recording an image on a decoloring type heat sensitive image recording material as claimed in claim 12, wherein the thermal energy is more than 10 mJ/mm$^2$.

14. The process of recording an image on a decoloring heat sensitive image recording material as claimed in claim 12, wherein the thermal energy is supplied from a thermal head of a thermal printer.

* * * * *